US005271780A

United States Patent [19]

Baigas, Jr.

[11] Patent Number: 5,271,780

[45] Date of Patent: Dec. 21, 1993

[54] ADSORBENT TEXTILE PRODUCT AND PROCESS

[75] Inventor: Joseph F. Baigas, Jr., Charlotte, N.C.

[73] Assignee: Kem-Wove, Incorporated, Charlotte, N.C.

[21] Appl. No.: 974,990

[22] Filed: Nov. 12, 1992

Related U.S. Application Data

[62] Division of Ser. No. 815,931, Dec. 30, 1991, Pat. No. 5,221,573.

[51] Int. Cl.[5] ..... B27N 3/00

[52] U.S. Cl. ..... 156/62.6; 19/145.7; 156/62.4; 156/276; 156/296

[58] Field of Search ..... 156/62.4, 62.6, 276, 156/296; 19/145.7

[56] References Cited

U.S. PATENT DOCUMENTS

| | | | |
|---|---|---|---|
| Re. 32,171 | 6/1986 | van Turnhout | 55/155 |
| 4,250,172 | 2/1981 | Mutzenberg et al. | 428/234 |
| 4,397,907 | 8/1983 | Rosser et al. | 428/240 |
| 4,411,948 | 10/1983 | Ogino et al. | 428/283 |
| 4,540,625 | 9/1985 | Sherwood | 428/283 |
| 4,668,562 | 5/1987 | Street | 428/218 |
| 4,753,693 | 6/1988 | Street | 156/34 |
| 4,765,812 | 8/1988 | Homonoff et al. | 55/524 |
| 4,828,913 | 5/1989 | Kiss | 428/283 |
| 4,851,274 | 7/1989 | D'Elia | 428/113 |
| 4,906,513 | 3/1990 | Kebbell et al. | 428/198 |
| 5,013,309 | 5/1991 | Baigas, Jr. et al. | 604/368 |

OTHER PUBLICATIONS

Ambersorb® Carbonaceous Adsorbents, Technical Notes, Specialty Publication.

Moldability of Rhoplex Tr-407, Technical Service Notes, Aug. 1, 1990.

Christy® Dry Material Dispensing Machines, Christy Machine Company.

*Primary Examiner*—James J. Bell

*Attorney, Agent, or Firm*—Bell, Seltzer, Park & Gibson

[57] ABSTRACT

An adsorbent textile product comprising a compressed nonwoven unitary batt of textile staple fibers, a cured binder disposed substantially throughout said batt, and an adsorbent material disposed substantially within the confines of said batt. In the disclosed product, the binder serves to hold the batt in its compressed condition such that the adsorbent is mechanically retained within the confines of the batt. In this way, the outer surfaces of said adsorbent material remain effectively free of the binder so that the adsorptive qualities of the adsorbent are preserved. An intermediate product and a process for making the disclosed products are also disclosed.

20 Claims, 3 Drawing Sheets

ADSORBENT TEXTILE PRODUCT AND PROCESS

This application is a divisional of application Ser. No. 07/815,931, filed on Dec. 30, 1991, U.S. Pat. No. 5,221,573.

FIELD OF THE INVENTION

This invention relates to a textile product having adsorbent qualities and more particularly to a textile product having a unitary layer of nonwoven staple fibers and an adsorbent material interposed therein.

BACKGROUND OF THE INVENTION

Particulate or fibrous adsorbent materials which can adsorb a wide variety of liquid and vapor phase contaminates are often incorporated in textile materials for the production of protective clothing, various liquid or vapor filter media, or the like. Examples of adsorbent materials which have been used are activated carbon, natural and synthetic zeolites, ion exchange resins, silica gel, alumina and other synthetic carbonaceous materials.

Due to the particulate or fibrous nature of these materials, however, in most such applications the material must be attached in some fashion to a substrate material. As an example, U.S. Pat. No. 4,250,172 to Mutzenburg et al. discloses a sandwich-type material wherein a particulate adsorbent is held between at least two fibrous mats. The multi-layered product is held together by needling, which mechanically interlocks the fibers of the respective layers in the thickness direction.

In another example, U.S. Pat. No. 4,411,948 to Ogino et al. describes an air-cleaning filter element prepared by adhesively adhering an adsorbent material, such as activated carbon, evenly across the opposed surfaces of a pair of three-dimensional mesh-structured elastic-flexible webs. Once the adsorbent is adhered to each of the webs, the opposed faces thereof are adhesively joined together to form the overall filter element.

The above described products, however, are undesirable in several respects. First, because the fibrous structure of the products is interrupted through the thickness of the product by the contained adsorbent material, the integrity in the thickness direction is weakened, leading to delamination and spillage of the adsorbent material. Second and from a manufacturing standpoint, the process for producing these products must include a needling, adhesive or other step to laminate the overall product. These additional steps are both costly and cumbersome. Third, with respect to those products where an adhesive is used to join the various layers, the adhesive tends to coat the active surfaces of the adsorbent material and thereby to unfavorably impact its adsorptive properties. And lastly, due to their multi-layered nature, such products are generally thicker and bulkier than desired, especially when the material is intended for use in protective clothing.

A third type of product similar to the present invention is disclosed in U.S. Pat. Nos. 4,397,907 to Rossen et al., and 4,540,625 to Sherwood, both assigned to Hughes Aircraft Company. These patents disclose an in situ composite containing organic polymeric fibers and solid adsorbent particles or fibers. The composites are prepared by providing a hot polymer solution of a fiber-forming polymer material and subsequently adding thereto a desired solid adsorbent material to form a suspension. The temperature of the solution is lowered while the solution is agitated whereby the polymer crystallizes to form fibers which precipitate from the solution, taking with them the solid adsorbent material. The resultant composite, which may be deposited onto a woven substrate to provide added structural integrity, may be used in protective clothing or as a filter medium or the like.

Although this product overcomes some of the above listed disadvantages, this product, for obvious reasons, must be made via a batch process, which is both costly and unsuited for mass production.

It is therefore an object of this invention to provide a strong, unitary textile product having excellent adsorptive qualities, that can be mass produced with relative ease, has structural integrity through its thickness, and can be produced at thicknesses easily incorporated into the protective clothing and small-sized liquid or vapor filters.

SUMMARY OF THE INVENTION

These and other objects and advantages of the present invention are accomplished by providing an adsorbent textile product characterized by a compressed nonwoven unitary batt of textile staple fibers, a cured binder disposed substantially throughout said batt, and an adsorbent material disposed substantially within the confines of said batt, wherein (1) the cured binder serves to hold the batt in its compressed condition, (2) the density of the compressed batt is of a magnitude relative to the average size of the adsorbent material such that the adsorbent material is retained within the confines of the batt, and (3) the outer surfaces of the adsorbent material are effectively free of said binder such that the adsorptive qualities of the adsorbent material ar preserved.

In a preferred embodiment of the present invention, the compressed nonwoven unitary batt contains at least two different denier of textile staple fibers, wherein the fibers are arranged within the batt such that the fibers of the smallest denier tend to congregate in the lower regions of the overall textile product, and the fibers of the largest denier tend to congregate in the upper regions of the product. In this way, because smaller denier fibers pack more densely than larger denier fibers, the density of the batt is at its highest near the lower surface of the product and at its lowest near the upper surface thereof.

As in the broader invention described above, the density of the compressed batt in the preferred embodiment is of a magnitude relative to the average size of the adsorbent material such that the adsorbent material is retained within the confines of such batt.

The method of making the product of the present invention is partially responsible for its improved features and qualities. The product may be made by a method whereby staple fibers are fed into an air-card assembly, passed through a downwardly-blowing air curtain, and collected in the form of a nonwoven unitary batt on a conveyor moving away from the air-card assembly. Thereafter, the batt is sprayed with a curable binder material which is then dried to its "B" stage. Next, an adsorbent material, such as a carbonaceous adsorbent, is sprinkled across the upper surface of the batt and allowed to settle into the interior of the moving batt. Thereafter, heat and compression are applied to the batt so as to compress the same and to fully cure the binder. After cooling, the compressed nature of the batt is maintained. Because the binder is applied to the batt and cured to its "B" stage before the adsorbent material is applied, the binder does not coat the active surfaces or otherwise clog the pores of the material such that the adsorbent qualities of the material is preserved.

In order to enable optimum loading of the adsorbent material into the batt, the density of the uncompressed batt should be of a magnitude relative to the average size of the adsorbent material such that the adsorbent material may settle into the thickness of the batt, but will not pass all the way through under their own weight.

In this regard, it is a preferred embodiment of the present invention to fabricate the invention using a precursor mixture of at least two different denier of fibers. When this is done and the fibers of the appropriate denier are used, the resultant nonwoven batt, in its uncompressed state, will have a lower region thereof which has a density relative to the average size of the adsorbent material such that the latter cannot pass through the thickness of the batt under its own weight. In addition, where the product is made in this fashion, and by the appropriate method described below, the density of the upper region of the nonwoven batt, in its uncompressed state, will be of a magnitude relative to the average size of the adsorbent material that the adsorbent material will easily settle into the interior of the batt. Because the density of the batt increases with depth, however, the descent of the material is inhibited by the increasing density of the batt as the material move toward the lower regions of the batt. In this way, the adsorbent material tends to settle into the medial depths of the batt.

BRIEF DESCRIPTION OF THE DRAWINGS

In the detailed description of the preferred embodiment of the invention presented below, reference is made to the accompanying drawings in which.

DETAILED DESCRIPTION OF THE PREFERRED EMBODIMENT

Figure 1:
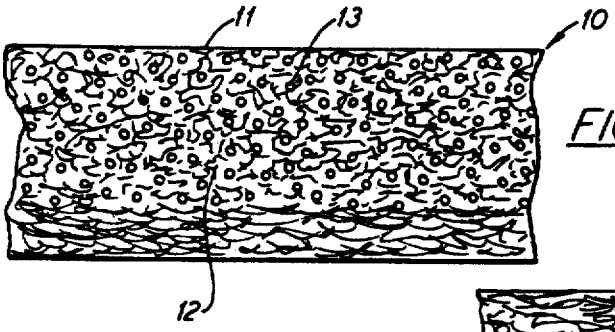
FIG. 1 is a perspective view of the product of the present invention.

With reference to the figures, FIG. 1 illustrates the adsorbent textile product 10 of the present invention. As shown, the product 10 contains a compressed, nonwoven unitary batt 11 of textile staple fibers 12, a cured binder disposed substantially throughout the batt (not shown), and an adsorbent material 13 disposed substantially within the confines of the batt.

The batt can be made in any width or length needed to fit a particular need or in standard sizes for die-cutting, etc., as needed to prepare protective clothing, filter media or the like.

The density of the batt in its final compressed state is important to optimum production of the present invention. That is, inasmuch as it is an object of the present invention to avoid coating the adsorptive with the binder so as to preserve the adsorptive qualities thereof, it is an important aspect of the present invention that the adsorbent material are mechanically rather than adhesively held within the overall batt. Accordingly, the density of the batt in its compressed state should be of a magnitude relative to the average size of the adsorbent material such that the various pieces of the material (i.e particles or fibers) will be mechanically "trapped" within the batt.

The density of the batt in the uncompressed state is also an important factor. In order to successfully load the adsorbent material into the confines of the batt, the density of the uncompressed batt should be small enough to allow the material to settle into the batt, yet large enough to stop it from falling through the batt under its own weight. The density of the batt can be adjusted, by choosing fibers of the appropriate denier and by manipulating various manufacturing parameters. Although it is not necessary, the settling process may be enhanced by agitating the moving batt to coax the adsorbent material into the batt.

Figure 2:
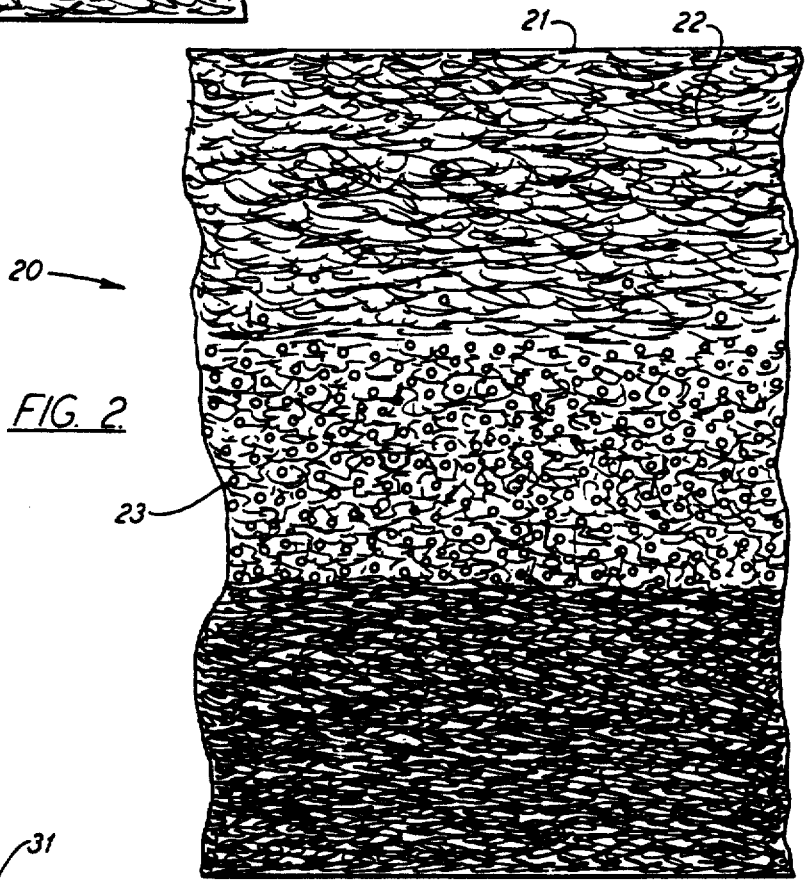
FIG. 2 is a perspective view of a preferred embodiment of the present invention in an uncompressed state.

A more preferred embodiment of the present invention is depicted in an uncompressed state in FIG. 2. In this embodiment, the product 20 is made of a batt 21 of nonwoven textile staple fibers 22 but, unlike the embodiment shown in FIG. 1, this batt is made of two different denier of fibers. The smallest denier fibers concentrate in the lower regions of the batt, while the largest denier fibers favor upper regions thereof. Consequently, the density of the batt increases with depth. Thus, the upper surface of the batt is "open" to accept the loading of the adsorbent material 23, whereas the lower regions are "closed" to prevent the adsorbent material 23 from falling through the batt 21 during the fabrication process. In addition, this arrangement of the fibers leads to an improved product by enabling the material to penetrate more easily into the medial depths of the batt. Preferably, the fibers chosen to makeup the batt in this embodiment will be such that the larger thereof is at least twice the denier of the smaller. In this way a more defined density gradient is achieved in the final product.

If desired, a precursor mixture having three or more different denier of fibers may be used. In such a case, the resultant batt will exhibit a gradient of the various denier through its thickness, with the largest denier fibers toward the upper surface and the smallest denier fibers toward the lower. Thus, the density of the batt in the thickness direction can be tailored as desired to allow optimum loading of the adsorbent material. If three or more different denier of fibers are used, each successive denier is preferably twice that of the next smallest denier in the batt.

Figure 3:
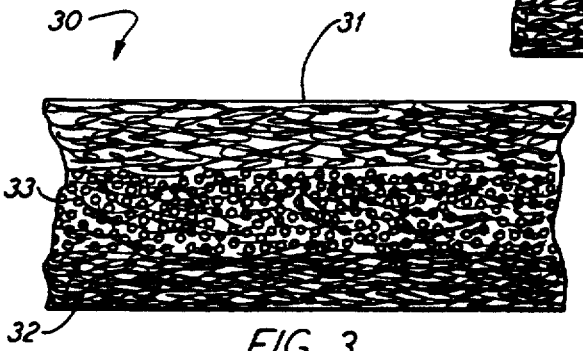
FIG. 3 is a perspective view of the embodiment shown in FIG. 2, but in a compressed state.

Once the adsorbent material 23 has been loaded into the batt, the overall batt is compressed to "close" the upper regions of the batt and to thus prevent any escape of the adsorbent material 23 through the upper side of the batt. The product is finished by curing the binder under heat and compression. The finished product 30, as shown in FIG. 3, has overall density such that the adsorbent material 33 is held within the confines of the batt 31 by the mesh-work of the fibers 32.

Figure 4:
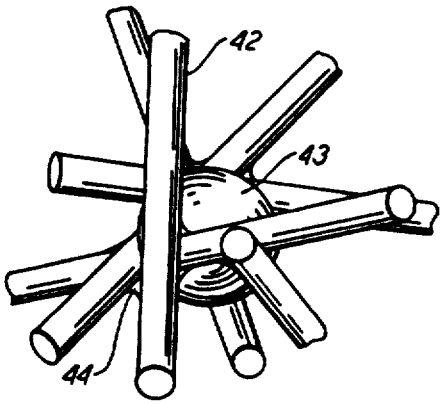
FIG. 4 is a magnified view of the fiber/binder/adsorbent material arrangement of the present invention.

As shown in FIG. 4 in a magnified view, the adsorbent material 43 is mechanically retained with the batt by the entanglement of the fibers 42 therein. Because the binder 44 is added to the batt and dried before the adsorbent material 43 is loaded therein, the binder does not coat or otherwise clog the active sites on the surface of the adsorbent material. Accordingly, the binder 44 does not adversely affect the adsorptive properties of the overall product.

The present invention can be made from any sort of textile fiber including synthetic fibers of polyester, nylon, or acrylic, and natural fibers such as cotton or wool. In addition, fibers of most any denier may be used, depending on the particular application and size of the chosen adsorbent material. Generally speaking, for the synthetic fibers, from 3 to 60 denier may be used and at lengths from ½ to 3 inches, preferably 1½ to 2½ inches. Crimp level is preferably from 9-13/inch of a sawtooth crimp. For natural fibers, any available cotton fibers, such as bleached cotton, raw cotton, or waste cotton, may be used. Wool fibers or silk fibers may also be used. For comparison, cotton fibers are equivalent to approximately a 1½ denier synthetic fiber.

In addition, in certain environments, such as when the textile product is to be incorporated into protective clothing, it is advantageous to use a mixture of natural and synthetic fibers in the batt. It is even more advantageous if such natural fibers are of a size relative to the synthetic fibers such that the natural and synthetic fibers are segregated to opposite surfaces of the batt. Such a product can advantageously be used in protective clothing by orienting the product with the natural side thereof facing the exterior of the garment. Since the natural fibers tend to wick liquids across a larger area of the product's surface, quicker volatilization of the liquid and thus a more efficient adsorption can be obtained.

The binder that is employed to hold the batt in its compressed state is another important aspect of the invention. The binder should be capable of existing in a stable, dry and uncured or "B" stage, as well as curable by heat, radiation and/or pressure and, when fully cured, stable, i.e. non-flowing, to temperatures as high as 350° F. In addition, the binder should be formable under heat and compression from its dry and uncured or "B" stage. Suitable binders are Rohm & Haas RHOPLEX TR-407, a self-crossing acrylic emulsion, and other cross-linkable binders having a $T_1$ (temperature at which the Torsional Module of air-dried film is 300 kg/cm$^2$) of or near 30° C.

The adsorbent material may be any known particulate or fibrous adsorbent and should be chosen with the end use environment in mind. Examples of suitable adsorbents are activated carbon; synthetic carbonaceous adsorbents, such as Rohm & Haas AMBERSORB® carbonaceous adsorbents; natural or synthetic ion exchange resins; natural or synthetic zeolites; silica gel; activated alumina; etc. These materials may be used in various sizes depending on the particular application, however, average sizes from 200-500 microns are generally preferred. In addition, the adsorbent material may be an electret, i.e. a dielectric particle or fiber carrying a permanent electrostatic charge, such as disclosed in, for example, U.S. Pat. No. Re. 32,171 to van Turnhout, the disclosure of which is incorporated herein by reference. Electrets are commonly used in the air filtration industry to filter particulates from the air. Useable electrets are preferably very fine, i.e. on the order of 5 microns or less in diameter. The appropriate size, however and as described above, is related to the denier of the fibers used to make the nonwoven batt.

Figure 5:
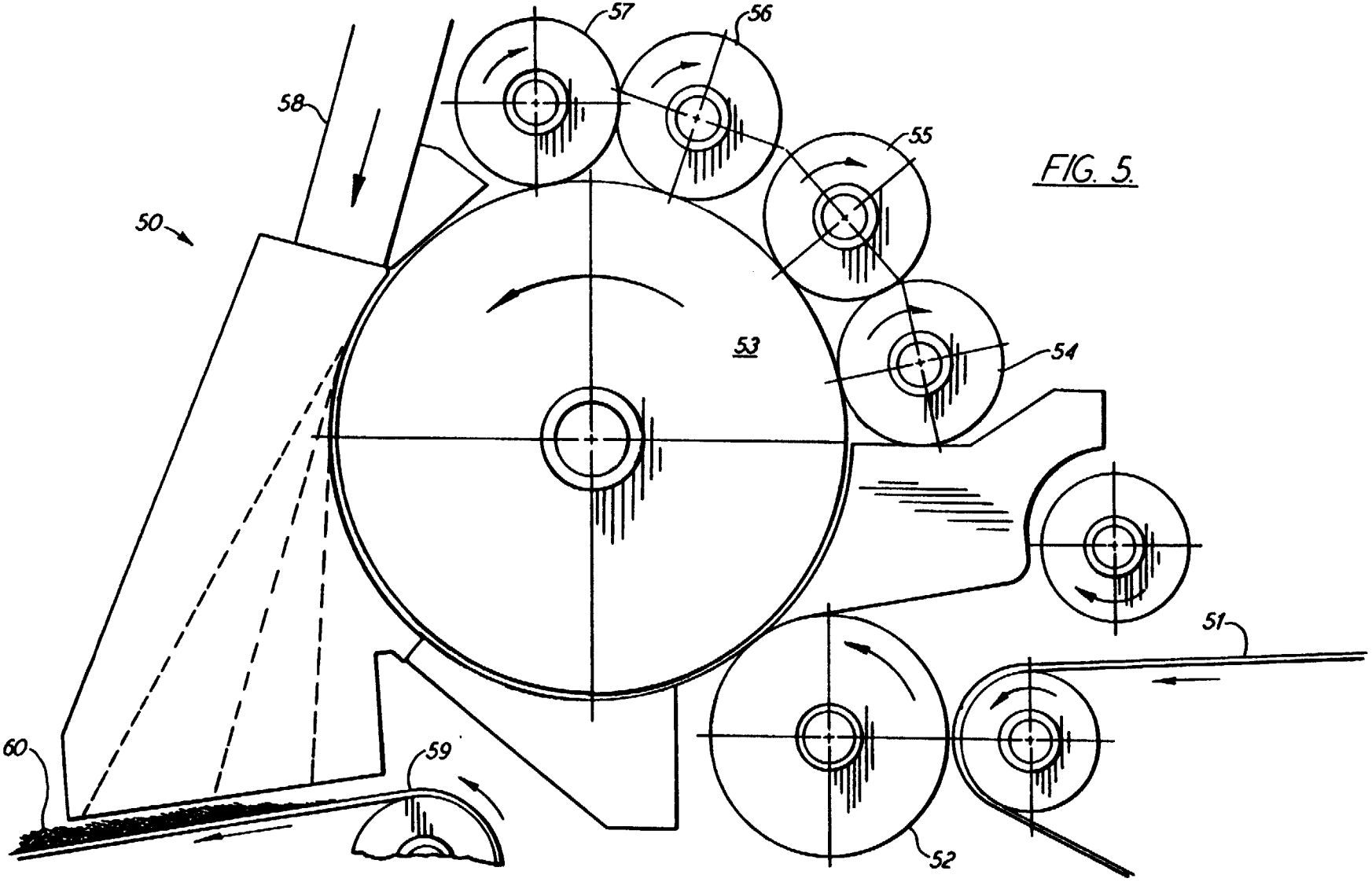
FIG. 5 is a schematic of an air-card assembly for use in making the claimed invention.

The preferred process for producing the products of the present invention is an air-lay method employing an air-card assembly as shown in FIG. 5. The first step of the process is to assemble a precursor mixture of suitable fibers. This precursor mixture is fed into the air-card assembly 50 by a feed conveyor 51 where it is lifted by lifting roller 52 into contact with the main roller 53 of the assembly. The main roller 53, in conjunction with a series of opposing rollers 54, 55, 56, 57, separates the individual fibers from the precursor mixture and casts the same into the downwardly blowing air curtain produced by the blower 58. This air curtain forces the individual fibers onto a take-off conveyor 59 where the fibers form a three-dimensional, nonwoven batt 60 in which fibers are oriented in the x, y, and z directions within the formed batt. By appropriately adjusting the speeds of the feed conveyor 51 and the take-off conveyor 59 and the velocity of the air curtain, the thickness and density of the batt can be controlled to within desired ranges.

In the preferred embodiment of this invention, where the precursor mixture contains at least two different denier of fibers, the air-card assembly 50 is operated at a high speed, preferably at a surface speed of the main roller 53 of 10,000 feet per minute, or 50 meters per second. At this speed, the carded fibers are cast from the main roller 53 by centrifugal force and thrown into the air curtain, which is preferably operating at a velocity of 2500 to 3500 feet per minute. This effect separates the fibers according to their denier, with the higher denier fibers being thrown further from the main roller than their lower rated counterparts. At lower speeds, a lesser degree of centrifugal force is present and thus lesser separation occurs.

As the fibers land on the take-off conveyor 59, which is moving away from the main roller 53 along the line of flight of the fibers, a batt 60 grows which has a greater concentration of the smallest denier fibers in the region nearest its lower surface, and a greater concentration of largest denier fibers in the region nearest its upper surface. This fiber arrangement results in a batt 60 having its greatest density near the lower surface and its least density near its upper surface. In this way, the produced batt is "open" on the upper side to the loading processes downstream, but "closed" on the lower side to spillage of the loaded adsorbent material as discussed above.

Once the nonwoven batt is prepared, an appropriate binder is sprayed into the batt with enough force to dispose the binder throughout the batt. In this regard, care must be taken to avoid an overly dense or overly thick batt which would inhibit sufficient binder penetration. As a general guide, the following Table lists the maximum batt thickness allowing complete penetration for a given uniform denier. Batts having multiple denier of fibers allow complete penetration at thicknesses proportional to the denier makeup of the overall batt. Of course, complete penetration is only an ideal goal and less efficient binder penetration can be accommodated in any given product as described below.

| Denier | Maximum Thickness for Complete Binder Penetration (inches) |
|---|---|
| 3 | ½ |
| 6 | 1 |
| 15 | 1½ |
| 60 | 3 |

The binder may be applied to the batt by ordinary means, such as a spray system using reciprocating or fixed spray nozzles aimed at both sides of the batt. To facilitate proper spraying, water and/or a surfactant may be admixed with the binder to form a sprayable emulsion.

The binder is generally applied to the batt at a fiber to binder dry weight ratio of from 85/15 to 60/40, however, the optimum ratio will depend on the particular application.

After the binder has been applied to the batt, the batt is passed through a typical drying oven where the temperature is controlled such that the binder will be dried, but little, if any, cross-linking will occur. Although the proper temperature and drying times will vary from binder to binder, if Rohm & Haas RHOPLEX TR-407 is used, sufficient drying can be accomplished at 225° F. for 30 seconds.

At this point in the process, the intermediate product may be formed into rolls of convenient length for storage, or may be moved into the next sequence for loading the batt with the adsorbent material. In the loading step, the adsorbent material can be loaded into the batt by using, for example, a gravity-fed hopper-type applicator, such as that manufactured by Christy Mfg. Co. of Fremont, Ohio. The adsorbent material, which generally range from 200 to 500 microns in average size (5 microns or less for electrets), is applied evenly across the upper surface of the batt at a rate of from about 10 to 30 grams per square meter, although that amount will vary depending on the application.

Next, the loaded batt is passed through a compressing and curing unit where the same is compressed, thus "closing" the upper surface of the batt to retain the adsorbent material within the confines thereof, and heated to fully cure the binder and thus hold the batt in its compressed and "closed" state.

The final product is a thin, pliable adsorbent textile product suitable for the fabrication of protective clothing or filter media or the like. In the latter case and where multiple fibers of denier are used, the filtrate should preferably flow from the low density side to the high density side of the filter. The filter will operate in the reverse direction, albeit less effectively.

Figure 6:
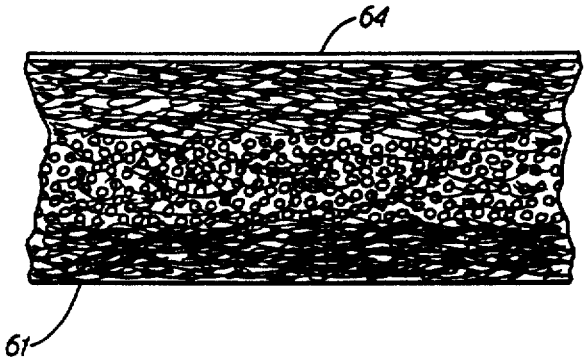
FIG. 6 is a perspective view of the present invention wherein the product contains an additional retaining layer to further entrap the adsorbent material within the confines of the batt.

As will be understood, there will be instances where a particular use of the present invention will dictate that the product be maintained at thicknesses where the upper surface of the batt cannot be entirely "closed" to escape of the adsorbent material during the compression step. In such instances, the adsorbent material can be entrapped within the confines of the batt by laminating to the upper surface of the batt a layer of thermo-responsive fibers that will fuse together under the heat of the final curing process. Such fibers should be of a smaller denier than those forming the upper surface of the batt and preferably applied to the upper surface by imposing a preformed layer or mesh of such fibers on the batt prior to the final heating and pressing step. A perspective view of such a product is shown in FIG. 6, wherein the batt 61 carries retaining layer 64 of thermo-responsive fibers. These thermo-responsive fibers are generally commercially available from, for example, DuPont Company and Eastman Kodak under the trade names DACRON Binder Fibers and KODEL, respectively.

The following examples are provided to further illustrate the present invention:

EXAMPLE 1

A uniform mixture of 25% by weight of 15 denier × 1½ inch polyester fiber (dia. = 39.19 microns); 25% by weight of 6 denier × 2 inch polyester fiber (dia. = 24.8 microns); and 50% by weight of 3 denier × 2 inch polyester fiber (dia. = 17.5 microns) was fed into an air-card assembly having a main roller operating at a surface speed of about 10,000 feet per minute or 50 meters per second. The carded fibers were cast from the main roller by centrifugal force into an air-curtain moving within the range of 2500 to 3500 feet per minute. After collecting the resultant batt to a thickness of approximately one inch, Rohm & Haas RHOPLEX TR-407 was applied at a 65:35 fiber:binder weight:weight ratio, and then dried to its "B" stage. At this point in the process the fiber plus binder weighed approximately 7.5 ounces per square yard.

Next, the batt was passed under a hopper-type dispenser where 20×50 mesh activated charcoal was loaded into the moving batt at 16.2 ounces per sq. yard. Once the charcoal particles were applied, the loaded batt was compressed to 0.2 inches in thickness for 30.60 seconds at 300° F., thus fully curing the binder to form the finished product.

EXAMPLE 2

A uniform mixture of 50% bleached cotton fiber (dia. = 12 microns) and 50% 6 denier non-crystalline polyester fiber (dia. = 24.8 microns) was fed into an air-card assembly as described in Example 1 yield a nonwoven batt weighing 2.0 ounces per square yard and 10 millimeters thick. The cotton fibers were segregated in the lower regions of the batt and the polyester fibers tended toward the upper regions thereof. Next, 20% dry weight of binder was sprayed on both surfaces of the batt, yielding a batt of 2.5 ounces per square yard. The adsorbent material was loaded into the polyester side of the binder as in Example 1 at a rate of 24 grams per square meter. The chosen adsorbent was Rohm & Haas AMBERSORB 572, with an average particle size of approximately 500 microns. These particles are spherical beads with exceptional physical integrity which allow easy loading into interior of the batt. Lastly, the loaded batt was compressed to a total thickness of 3.0 millimeters and heated to fully cure the binder.

The final product exhibited a relatively soft hand, and good breathability and adsorbed greater than 1.8 $mg/cm^2$ of carbon tetrachloride using ASTM test method B-3467-88.

It should be recognized that the embodiments disclosed herein are shown for exemplary purposes and are not intended to limit the scope of the present invention, the scope of the invention being defined by the claims hereinbelow.

That which is claimed is:

1. A process for producing an adsorbent nonwoven textile product comprising the steps of assembling a mixture of at least two different denier of textile staple fibers; processing said mixture through an air-card assembly operating at a surface speed of the main roller of at least about 10,000 feet per minute to separate said mixture into individual fibers; passing said separated fibers through a downwardly-blowing air curtain; collecting said mixture of fibers in the form of a nonwoven batt upon a conveyor moving away from said air-card assembly so that said batt has upper and lower regions thereof formed of said fibers; spraying a curable binder into said batt; drying said binder to its "B" stage; adding an adsorbent material to said batt with the dried binder thereon; thereafter applying a compressive force to said batt and, while maintaining said compressive force, curing said binder such that the adsorbent material is confined within the interior of the fibrous material by the compressed state thereof without the binder having any substantial effect on the adsorptive qualities of the adsorbent material.

2. A process according to claim 1 wherein said fibers are selected from the group consisting of synthetic fibers and natural fibers.

3. A process according to claim 1 wherein said mixture comprises fibers having a relatively small denier and fibers having a relatively larger denier, wherein larger denier is at least about twice said small denier.

4. A process according to claim 1 wherein said upper region has a greater concentration of 15 denier fibers than other portions of the batt, and said lower region has a greater concentration of 3 denier fibers than other portions of the batt.

5. A process according to claim 1 wherein said mixture comprises three or more different denier of fibers.

6. A process according to claim 5 wherein each successive denier in said batt is at least twice that of the next smallest denier.

7. A process according to claim 1, wherein said mixture comprises about 25% by weight of 15 denier × 1½ inch fibers, about 25% by weight of 6 denier × 2 inch fibers, and about 50% by weight of 3 denier × 2 inch fibers.

8. A process according to claim 1 wherein said fibers are three-dimensionally arranged within the batt.

9. A process according to claim 1 wherein said adsorbent material is selected from the group consisting of natural zeolites, synthetic zeolites, ion exchange resins, natural carbonaceous materials, synthetic carbonaceous materials, and electrets.

10. A process according to claim 1 further comprising the step of imposing a retaining layer of thermally-responsive fibers on the surface of said batt adjacent said upper regions thereof and thermally bonding said retaining layer the upper surface of the batt during said curing step.

11. A process for producing an adsorbent nonwoven textile product comprising the steps of assembling a mixture of textile staple fibers; processing said mixture through an air-card assembly to separate said mixture into individual fibers; passing said separated fibers through a downwardly-blowing air curtain; collecting said mixture of fibers in the form of a nonwoven batt upon a conveyor moving away from said air-card assembly; spraying a curable binder upon said batt; drying said binder to its "B" stage; adding an adsorbent material to said batt with the dried binder thereon; thereafter applying a compressive force to said batt and, while maintaining said compressive force, curing said binder such that the adsorbent material is confined within the interior of said batt by the compressed stat thereof without the binder having any substantial effect on the adsorbent qualities of the adsorbent material.

12. A process according to claim 11 wherein said fibers are selected from the group consisting of synthetic fibers and natural fibers.

13. A process according to claim 11 wherein said mixture comprises fibers having a relatively small denier and fibers having a relatively larger denier, said larger denier being at least twice said smaller denier.

14. A process according to claim 11 wherein said batt has upper and lower regions, and wherein said upper region has a greater concentration of 15 denier fibers than other portions of the batt, and said lower region has a greater concentration of 3 denier fibers than other portions of the batt.

15. A process according to claim 11 wherein said mixture comprises fibers having three or more different denier.

16. A process according to claim 15 wherein each successive denier in said batt is at least twice the next smallest denier.

17. A process according to claim 11 wherein said mixture comprises about 25% by weight of 15 denier × 1½ inch fibers, about 25% by weight of 6 denier × 2 inch fibers, and about 50% by weight of 3 denier × 2 inch fibers.

18. A process according to claim 11 wherein said fibers are three-dimensionally arranged within the batt.

19. A process according to claim 11 wherein said adsorbent material is selected from the group consisting of natural zeolites, synthetic zeolites, ion exchange resins, natural carbonaceous materials, synthetic carbonaceous materials, and electrets.

20. A process according to claim 11 wherein said batt has upper and lower regions, and wherein said process further comprises the step of imposing a retaining layer of thermally-responsive fibers on the surface of said batt adjacent the upper regions thereof and thermally bonding said retaining layer to the upper surface of said batt to further entrap said adsorbent within the confines thereof.

* * * * *

UNITED STATES PATENT AND TRADEMARK OFFICE

CERTIFICATE OF CORRECTION

PATENT NO. : 5,271,780

DATED : December 21, 1993

INVENTOR(S) : Joseph F. Baigas, Jr.

It is certified that error appears in the above-identified patent and that said Letters Patent is hereby corrected as shown below:

Col. 8, line 23, "30.60" should be --30-60--

Signed and Sealed this

Ninth Day of August, 1994

*Attest:*

*Attesting Officer*

BRUCE LEHMAN

*Commissioner of Patents and Trademarks*